US009328732B2

(12) United States Patent
Wang et al.

(10) Patent No.: US 9,328,732 B2
(45) Date of Patent: May 3, 2016

(54) AUTOMATIC COMPENSATION MECHANISM FOR HINGE SEAL GAP IN SPHERICAL COMPRESSOR

(75) Inventors: Mengying Wang, Xi'an (CN); Luyi Wang, Xi'an (CN)

(73) Assignee: Xi'an Zhengan Environmental Technology Co., Ltd. (CN)

( * ) Notice: Subject to any disclaimer, the term of this patent is extended or adjusted under 35 U.S.C. 154(b) by 473 days.

(21) Appl. No.: 13/819,314

(22) PCT Filed: Jul. 20, 2011

(86) PCT No.: PCT/CN2011/077360

§ 371 (c)(1),
(2), (4) Date: May 29, 2013

(87) PCT Pub. No.: WO2012/024991

PCT Pub. Date: Mar. 1, 2012

(65) Prior Publication Data

US 2014/0159313 A1 Jun. 12, 2014

(30) Foreign Application Priority Data

Aug. 26, 2010 (CN) ..... 2010 1 0264211

(51) Int. Cl.
*F04C 27/00* (2006.01)
*F01C 19/00* (2006.01)
(Continued)

(52) U.S. Cl.
CPC ..... *F04C 27/001* (2013.01); *F01C 19/005* (2013.01); *F04C 18/54* (2013.01); *F04C 21/005* (2013.01); *F04C 2240/20* (2013.01); *F04C 2240/56* (2013.01)

(58) Field of Classification Search
CPC ..... F04C 27/00; F04C 27/001; F04C 27/007; F04C 18/34; F04C 18/48; F04C 18/54; F04C 21/00; F04C 21/002; F04C 21/005; F01C 3/06
USPC ..... 418/5, 68, 118, 140, 142, 143, 195; 403/119–125; 16/224
See application file for complete search history.

(56) References Cited

U.S. PATENT DOCUMENTS 1,678,049 A 5/1926 Kearney
1,612,287 A * 12/1926 Holmes ..... 418/68
(Continued)

FOREIGN PATENT DOCUMENTS

CH 231548 * 3/1944 ..... F04C 3/06
CN 86100534 A 9/1987
(Continued)

OTHER PUBLICATIONS

Wang, MengYing et al., International Search Report issued in parent International Patent Application No. PCT/CN2011/077360 on Oct. 27, 2011.

*Primary Examiner* — Daniel P Stodola
*Assistant Examiner* — Jonathan Masinick
(74) *Attorney, Agent, or Firm* — Laura M. Lloyd; Leech Tishman Fuscaldo & Lampl

(57) ABSTRACT

Disclosed is an automatic compensation mechanism for a hinge seal gap in a spherical compressor. A cylindrical hinge formed around a central pin (1), a rotating disk pin seat (81), and a piston pin seat (16) of the spherical compressor. A fan-shaped insert (14) thicker at both sides and thinner in the center thereof is disposed at the bottom of a sump (161) on the pin seat of the cylindrical hinge. The shape of the insert (14) marches the shapes of the sump (161) and of the external cylindrical surface of a semi-cylinder (811) on the pin seat of the cylindrical hinge respectively, forming a dynamic seal fit, thus improving the reliability of the seal, adapting to mass production, and enhancing overall performance.

6 Claims, 3 Drawing Sheets

(51) Int. Cl.
*F04C 18/54* (2006.01)
*F04C 21/00* (2006.01)

(56) References Cited

U.S. PATENT DOCUMENTS

| | | | | | |
|---|---|---|---|---|---|
| 2,489,041 | A | * | 11/1949 | Manseau | 418/49 |
| 2,674,952 | A | * | 4/1954 | Jacobsen | 418/193 |
| 3,877,850 | A | * | 4/1975 | Berry | 418/68 |
| 4,318,675 | A | | 3/1982 | Clarke et al. | |
| 4,631,011 | A | * | 12/1986 | Whitfield | 418/68 |
| 5,053,655 | A | | 10/1991 | Benschop et al. | |
| 5,171,142 | A | * | 12/1992 | Proglyada | 418/68 |
| 5,309,716 | A | * | 5/1994 | Kolbinger | 60/519 |
| 8,424,505 | B2 | * | 4/2013 | Nagy | 123/205 |
| 2002/0094293 | A1 | * | 7/2002 | Klassen | 418/195 |
| 2010/0034680 | A1 | * | 2/2010 | Arnold | 418/1 |

FOREIGN PATENT DOCUMENTS

| | | | | | |
|---|---|---|---|---|---|
| CN | 2078807 | U | | 6/1991 | |
| CN | 1431400 | A | | 7/2003 | |
| CN | ZL03114505.1 | A | | 7/2005 | |
| CN | 101929463 | A | | 12/2010 | |
| CN | 201810554 | U | | 4/2011 | |
| DE | 2161572 | | * | 6/1973 | F04C 18/54 |
| FR | 1190535 | | * | 10/1959 | F04C 18/54 |
| GB | 398395 | | * | 9/1933 | F04C 3/06 |
| JP | 5018376 | A | | 1/1993 | |
| WO | WO 2008034331 | A1 | * | 3/2008 | F04C 21/00 |

* cited by examiner

AUTOMATIC COMPENSATION MECHANISM FOR HINGE SEAL GAP IN SPHERICAL COMPRESSOR

CROSS-REFERENCE TO RELATED APPLICATIONS

The present Application is a national stage of International Patent Application No. PCT/CN2011/077360, titled "Automatic Compensation Mechanism for Hinge Seal Gap in Spherical Compressor," filed Jul. 20, 2011, which claims priority from Chinese Patent Application No. 201010264211.8, filed Aug. 26, 2010, the contents of which are incorporated in this disclosure by reference in their entirety.

FIELD OF THE INVENTION

The present disclosure relates to a hinge seal structure, and more particularly to seal for a hinge structure where a piston is connected with a rotating disk in a spherical compressor.

BACKGROUND OF THE INVENTION

The Chinese patent ZL03114505.1, entitled "a displacement mechanism for a compressor", discloses a new type of displacement compressor with the advantages such as the absence of inlet valve and exhaust valve, a small number of moving parts, small vibration, high mechanical efficiency and reliable seal.

However, in the aforementioned patent, there exist implementation defects in design of the hinge structure where the piston is connected with the rotating disk. In the Chinese patent ZL03114505.1, there is a structure in which a piston pin seat is matched with a rotating disk pin seat and is connected therewith by a central pin to form cylindrical hinge joint. In such a structure, the piston pin seat has a convex structure lower at both sides and higher in a center thereof, with concave semi-cylindrical grooves at both sides and a convex semi-cylinder in the center; the rotating disk pin seat has a concave structure higher at both sides and lower in a center thereof, with convex semi-cylinders at both sides and a concave semi-cylindrical groove in the center; the convex piston pin seat and the concave rotating disk pin seat are embedded, and then connected with each other by the central pin being inserted into corresponding pin holes on the convex semi-cylinders thereof, thereby forming a cylindrical hinge with sealability penetrating a diameter of a spherical inner chamber of a cylinder (that is, a complete semi-cylindrical contact surface is formed between the facing semi-cylindrical groove and the semi-cylinder). However, for the aforementioned concave pin seat, it is difficult to process the concave semi-cylindrical groove in the center to be a complete semi-cylindrical surface capable of forming seal fit with the corresponding semi-cylinder due to its special structure. Such a structure is not suitable for mass production and cannot ensure accuracy, thereby influencing seal efficiency and overall performance. In another structure, there does not exist any center pin, a "C"-shaped hinge column sleeve with an opening formed on the rotating disk less than 180 degrees and a "Ω"-shaped cylindrical rotating shaft formed on the piston form cylindrical hinge joint, which has the function of hinge joint to some extent, but this kind of structure is poor in load carrying, is apt to be deformed when there is high pressure gas in the cylinder, causes sealing failure and will increase mechanical friction at other parts.

As such, with years of related experience in design and manufacture, the inventor proposes an automatic compensation mechanism for hinge seal gap in spherical compressor to overcome the defects in the prior art.

SUMMARY OF THE INVENTION

The object of the present invention is to design a new type of hinge seal structure for a spherical compressor on the basis of the Chinese patent ZL03114505.1 so as to overcome the defects in the Chinese patent ZL03114505.1, improve the reliability of the seal, and adapt to mass production, thereby enhancing overall performance.

The object of the present invention is achieved as follows. In an automatic compensation mechanism for a hinge seal gap in a spherical compressor, a cylindrical hinge is formed around a central pin, a rotating disk pin seat, and a piston pin seat of the spherical compressor; a fan-shaped insert thicker at both sides and thinner in a center thereof is disposed at a bottom of a groove on the pin seat forming the cylindrical hinge, and the insert has a shape which matches that of the groove and of an external cylindrical surface of a semi-cylindrical protrusion corresponding to the groove, respectively forming a dynamic seal fit.

In a preferable embodiment of the present invention, one of the pin seats is a convex pin seat lower at both sides and higher in a center thereof, and the other of the pin seats is a concave pin seat higher at both sides and lower in a center thereof; for the convex pin seat, concave semi-cylindrical grooves are at both sides and a convex semi-cylinder is in the center; for the concave pin seat, convex semi-cylinders are at both sides and a sump with a smooth bottom surface is in the center; the convex pin seat and the concave pin seat are embedded, and then connected with each other by the central pin being inserted into corresponding pin holes on the convex semi-cylinders thereof; the insert is disposed between a bottom of the sump in the center of the concave pin seat and a top of the semi-cylinder in the center of the convex pin seat, the insert has a top surface which is fitted with the bottom surface of the sump in shape, the insert has a bottom surface which is fitted with an external cylindrical surface of the semi-cylinder of the convex pin seat correspondingly embedded in the sump in shape, and the insert is in dynamic seal fit with the concave pin seat and the convex pin seat, thereby forming a cylindrical hinge with sealability.

In a preferable embodiment of the present invention, semi-cylindrical contact surfaces in dynamic seal fit are formed between the semi-cylindrical grooves at both sides of the convex pin seat and the semi-cylinders at both sides of the concave pin seat.

In a preferable embodiment of the present invention, two end surfaces of the insert are planes and form dynamic seal fit with two side walls of the sump; two side surfaces of the insert are planes, the two side surfaces of the insert after loaded in the sump are aligned with the top surfaces at two end-sides of the sump; when one of working chambers which perform compression alternatively and are formed at two sides of the cylindrical hinge is in a high pressure state, the side surface of the insert located at the working chamber is pressurized, and the insert relatively moves slightly towards the other low pressure side, thereby reducing a gap between the insert and the bottom surface of the sump as well as the cylindrical surface of the semi-cylinder close to the high pressure side. Moreover, the greater the pressure is, the smaller the gap becomes.

In a preferable embodiment of the present invention, the top surface of the insert is a convex arc surface, and the bottom surface of the sump matched therewith is also an arc surface.

In a preferable embodiment of the present invention, the top surface of the insert is a plane, and the bottom surface of the sump matched therewith is also a plane.

In a preferable embodiment of the present invention, the piston pin seat is a concave pin seat and the rotating disk pin seat is a convex pin seat.

In a preferable embodiment of the present invention, the piston pin seat is a convex pin seat and the rotating disk pin seat is a concave pin seat.

The present invention has the advantages in that:

(1) the in-cylinder pressure changing alternatively is taken as a power source, the radial gap of the cylindrical hinge close to the high pressure side becomes small by the displacement of the insert, and the greater the pressure difference is, the more reliable the seal becomes, which can be called as an automatic compensation mechanism for gap;

(2) in the view of the structure design, the present invention ensures the feasibility of mass production; the double dot dash line in FIG. 9 represents the position of a rotary tool;

(3) due to the design of the automatic compensation mechanism for gap, the manufacturing accuracy for radial fit of the middle portion of the hinge structure is significantly reduced, thereby reducing the manufacturing difficulty and lowering the manufacturing cost;

(4) since the swing speed of the piston relative to the rotating disk will not exceed 20% of the rotating speed of the spindle in practical operation, and the two working chambers perform compression alternatively, the lubricating condition can ensure that each part has oil films, so high energy consumption and damage caused by surface friction will not occur at the insert; and (5) since the amount of displacement of the insert is very small and the inserts move alternatively, with oil film among each of the gaps, there will not cause impact 30 noise or damage.

BRIEF DESCRIPTION OF THE DRAWINGS

The following drawings are only intended to schematically explain the present invention and do not define the scope of the present invention, wherein.

Figure 1:
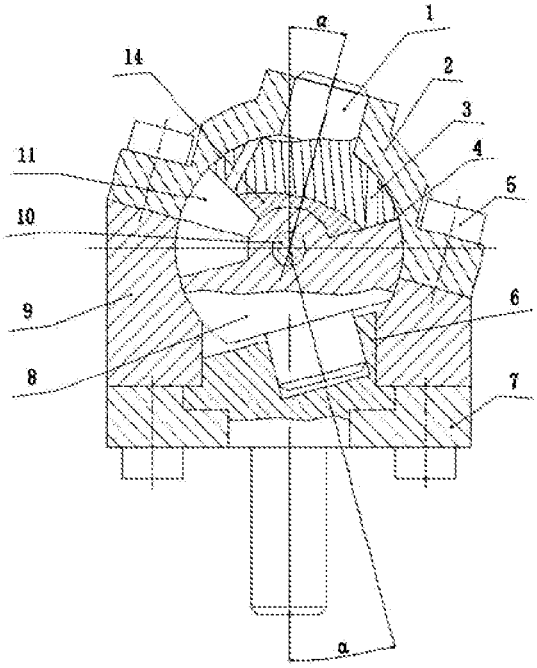
FIG. 1: a structural section diagram.

In the drawings: 1-piston; 2-cylinder cover; 3-air passage; 4-V1 working chamber; 5-coupling screw; 6-spindle; 7-spindle bracket; 8-rotating disk; 9-cylinder body; 10-central pin; 11-V2 working chamber; 12-exhaust passage; 13-inlet passage; 14-insert; 15-side surface of the piston; 16-piston pin seat; 161-sump; 1611-two side walls of the sump; 162-pin hole; 81-rotating disk pin seat; 811-semi-cylinder; 812-semi-cylindrical groove; 813-pin hole; 141-top surface of the insert; 142-bottom surface of the insert; 143-two side surfaces of the insert; 144-two end surfaces of the insert.

DETAILED DESCRIPTION OF THE EMBODIMENTS

In order to understand the technical features, objects and effects of the present invention more clearly, the embodiments of the present invention will be now explained with reference to the drawings.

Figure 2:
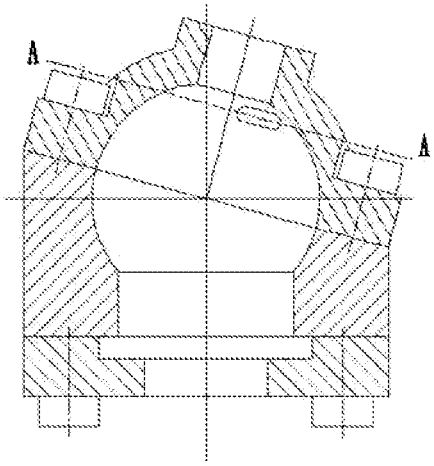
FIG. 2: a section diagram of an enclosure.
Figure 9:
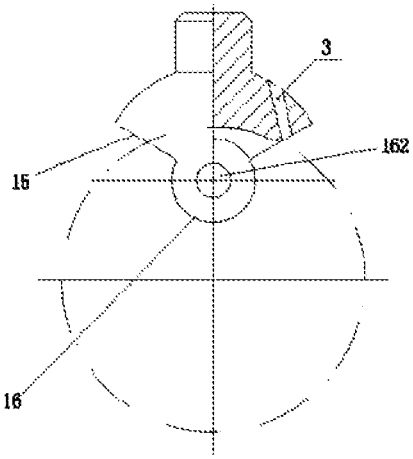
FIG. 9: a front view of the piston.
Figure 10:
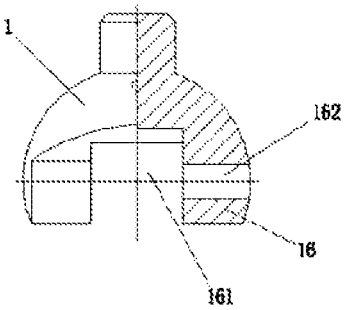
FIG. 10: a left view of the piston shown in FIG. 9.

FIG. 1 is a structural section diagram of the embodiment of the spherical compressor of the present invention. The spherical compressor comprises a cylinder body 9, a cylinder cover 2, a piston 1, an insert 14, a rotating disk 8, a spindle 6, a spindle bracket 7 and a central pin 10, wherein the cylinder body 9 and the cylinder cover 2 are connected by a coupling screw 5 to form a spherical inner chamber (as shown in FIG. 2); as shown in FIG. 9 and FIG. 10, the piston 1 has a spherical top surface, from the center of which extending a piston shaft, two side surfaces 15 with a certain angle, an air passage 3 and a piston pin seat 16 formed at the lower part of the two side surfaces of the piston 1. The piston pin seat has a semi-cylindrical structure with a groove provided in the center of the semi-cylinder, the groove being a sump 161 with a smooth bottom surface, thereby forming the concave pin seat higher at both sides and lower in the center thereof. A penetrating pin hole 162 is formed in the direction of an axis of the piston pin seat 16; a shaft hole matched with the piston shaft is provided on the cylinder cover 2. The piston 1 can freely rotate in the shaft hole around the piston shaft, and the spherical top surface of the piston and the spherical inner chamber share the same center of sphere and form dynamic seal fit.

Figure 4:
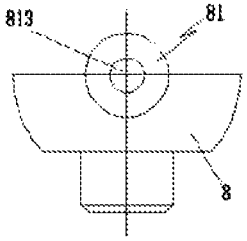
FIG. 4: a front view of the rotating disk.
Figure 5:
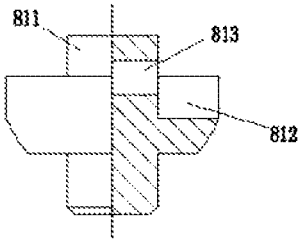
FIG. 5: a left view of the rotating disk shown in FIG. 4.
Figure 6:
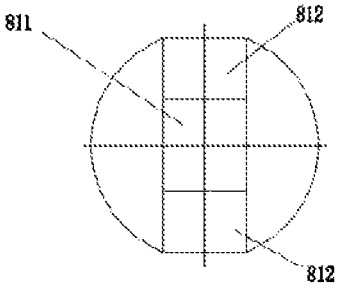
FIG. 6: a top view of the rotating disk shown in FIG. 4.

As shown in FIG. 4, FIG. 5 and FIG. 6, a rotating disk shaft extends from the center 20 of the lower end surface of the rotating disk 8, the peripheral surface between the upper part and the lower end surface of the rotating disk 8 is the rotating disk spherical surface, the rotating disk spherical surface shares the same center of sphere with the spherical inner chamber and clings to the spherical inner chamber to form dynamic seal fit; a rotating disk pin seat 81 is provided at the upper part of the rotating disk 8 corresponding to the piston pin seat 16, the two ends of the rotating pin seat 81 are semi-cylindrical grooves 812, and the center is a convex semi-cylinder 811, thereby forming a convex pin seat lower at both sides and higher in the center thereof; a penetrating pin hole 813 is provided in the direction of the axis of the rotating disk pin seat 81.

The central pin 10 is inserted into the piston pin seat 16 and the rotating disk pin seat 81, the spindle bracket 7 and the cylinder body 9 are connected by the coupling screw 5 to provide supporting for the rotation of the spindle 6, one end of the spindle 6 has an eccentric inclined hole which is located in the cylinder body 9 and is connected with the rotating disk shaft, the other end of the spindle 6 is connected with an actuating mechanism for supplying power to the displacement of the compressor; the axes of the above piston shaft and the rotating shaft as well as the spindle 6 all pass through the center of sphere of the spherical inner chamber, and the axes of the piston shaft and the rotating shaft form the same included angle $\alpha$ with the axis of the spindle 6.

Figure 11:
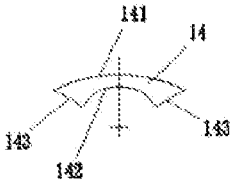
FIG. 11: a front view of the insert.
Figure 12:
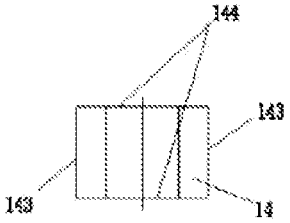
FIG. 12: a top view of the insert shown in FIG. 11.

After the piston pin seat 16 and the rotating disk pin seat 81 are embedded, the central pin 10 is inserted into the corresponding pin holes on the convex semi-cylinders of the convex pin seat and the concave pin seat to form the cylindrical hinge joint, a semi-cylindrical contact surface in perfect dynamic seal fit is formed between the semi-cylindrical grooves 812 at both sides of the convex pin seat and the semi-cylinders at both sides of the concave pin seat; a receiving space is formed between the bottom of the sump 161 in the center of the piston pin seat 16 and the top of the semi-cylinders 811 in the center of the rotating disk pin seat 81, the insert 14 is disposed in the receiving space, located at the bottom of the sump 161, with a fan-shaped structure thicker at both sides and thinner in the center thereof (as shown in FIGS. 11 and 12), the top surface 141 of the insert 14 is fitted with the bottom surface of the sump 161 in shape, the bottom surface 142 of the insert 14 is fitted with the external cylindrical surface of the semi-cylinder 811 of the rotating disk pin seat 81 in the correspondingly embedded sump 161 in shape, and the insert 14 is in dynamic seal fit with the piston pin seat 16 and the rotating disk pin seat 81; therefore, the piston 1 and the rotating disk 8 form movable seal connection by the cylindrical hinge, and the semi-spherical hollow chamber formed by the upper end surface of the rotating disk 8 and the spherical inner chamber is divided into the V1 working chamber 4 and the V2 working chamber 11.

Figure 7:
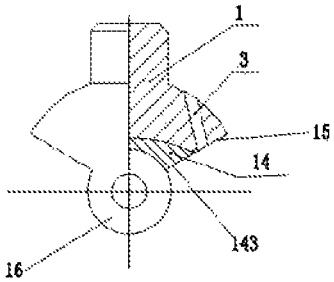
FIG. 7: a front view of an assembly of the piston and the insert.
Figure 8:
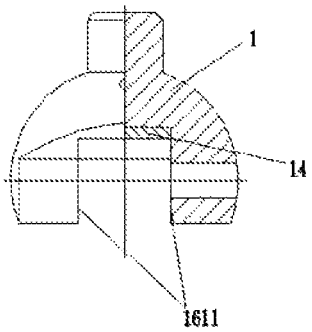
FIG. 8: a left view of the assembly of the piston and the insert shown in FIG. 7.

In the present embodiment, as shown in FIG. 11 and FIG. 7, the top surface 141 of the insert 14 is a convex arc surface, the bottom surface of the sump 161 matched therewith is also an arc surface; the bottom surface 142 of the insert 14 has a shape of an inner cylindrical surface, and is fitted with the shape of the outer surface of the convex semi-cylinder 811 of the rotating disk 8 to form dynamic seal fit; as shown in FIG. 7, FIG. 11 and FIG. 12, the two side surfaces 143 of the insert 14 are aligned with the wedged surface 15 of the piston, the two end surfaces 144 of the insert 14 forms dynamic seal fit with the two side walls 1611 of the sump 161 in the center of the piston pin seat 16 (as shown in FIG. 8); the piston 1 and the insert 14 are assembled to form the overall assembled piston of the spherical compressor, and the structure of the assembly of the piston 1 and the insert 14 is as shown in FIG. 7 and FIG. 8.

Figure 13:
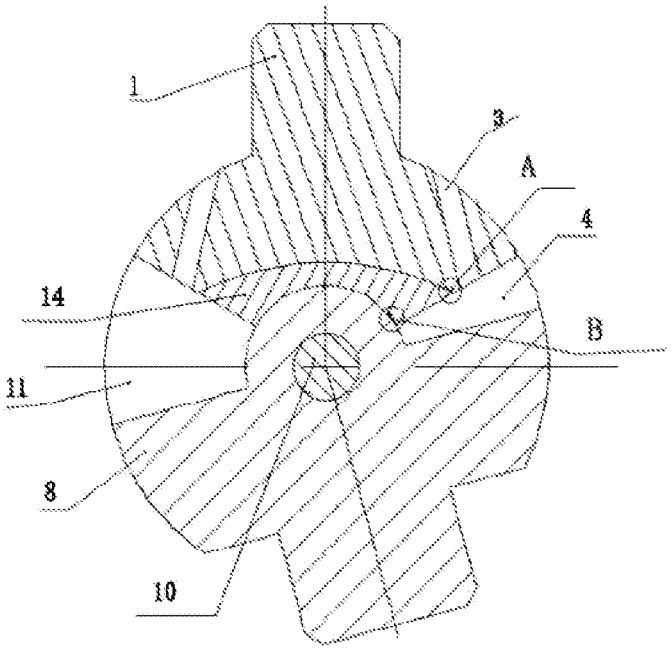
FIG. 13: an enlarged view of the cylindrical hinge seal structure.

FIG. 13 is an enlarged view of the cylindrical hinge seal structure. A cylindrical hinge is formed around a central pin 10, a rotating disk 8, and a piston 1 of the spherical 15 compressor. A fan-shaped insert 14 thicker at both sides and thinner in the center thereof is disposed at the bottom of a sump 161 on the piston pin seat 16 of the piston 1 forming the cylindrical hinge. The shape of the insert 14 matches the shapes of the sump 161 and of the external cylindrical surface of a semi-cylinder corresponding to the sump 161, respectively forming a dynamic seal fit. The bottom surface of the insert 14 is an inner cylindrical 20 surface which is matched with the semi-cylindrical surface of the semi-cylinder 811 on the rotating disk pin seat 81 to form dynamic seal fit; the two end surfaces of the insert 14 are planes, and form dynamic seal fit with the two side walls of the sump 161 of the piston pin seat; the top surface 141 of the insert 14 is fitted with the bottom surface of the sump 161 of the piston pin seat 16 in shape and forms dynamic seal fit therewith, the top surface 141 25 of the insert 14 in the present embodiment is an arc surface, and the bottom surface of the sump 161 of the piston pin seat 16 matched therewith is also an arc surface, which is beneficial to the cutting of the rotary tool and mass production, the double dot dash line in FIG. 9 represents the position of the rotary tool; the two side surfaces 143 of the insert 14 are planes, the two side surfaces 143 of the insert 14 after loaded in the sump 161 of the 30 piston pin seat 16 are aligned with the top surfaces at two end-sides of the sump 161 (that is, the wedged plane of the piston 1); when one of the working chambers which perform compression alternatively and are formed at two sides of the cylindrical hinge is in a high pressure state, for example, when the V1 working chamber in the drawing is in the high pressure state, and the V2 working chamber 11 is in the low pressure state, the working medium inside the V1 working chamber 4 leaks towards the V2 working chamber 11 with low pressure through various gaps, but since the side surface of the insert 14 located at the V1 working chamber 4 is pressurized, and the insert 14 relatively moves slightly towards the other low pressure side due to the structure of the insert 14 thicker 5 at both sides and thinner in the center thereof, the position A on the piston 1 to which reference character A points and the position B on the rotating disk 8 to which reference character B points prevent the insert 14 from moving, the minor movement making the gap between the two minimum; when the V2 working chamber 11 is in high pressure state, there has the same effect. The V1 working chamber 4 and the V2 working chamber 11 10 change alternatively in pressure, and the inserts 14 move slightly from the high pressure chamber to the low pressure chamber alternatively, which has the function of automatically reducing the radial seal gap in the center of the hinge at the high pressure side (the greater the pressure is, the smaller the gap becomes) and preventing the working medium from leaking from the high pressure chamber to the low pressure chamber.

Figure 3:
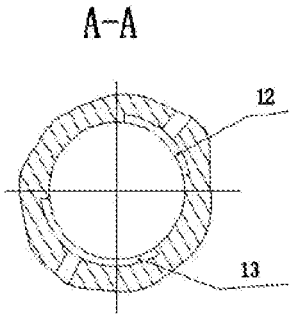
FIG. 3: a section diagram of line A-A taken in FIG. 2.

The spindle 6 drives the rotating disk 8 when rotating, the rotating disk 8 drives the piston 1 to move (the rotating direction of the spindle 6 in the drawing is clockwise as seen from the cylinder cover 2); the movement of the piston 1 is the unique rotation around the self axis, the movement of the rotating disk 8 is the combination of two movements: one is the rotation around the self axis, and the other is to move with its axis always passing through the center of sphere of the spherical cylinder in a circumferential direction on a virtual cone surface with the center of sphere of the cylindrical cylinder as a peak, the taper angle being $2\alpha$, and the axis overlapping with that of the spindle 6 (that is, the axis of the rotating disk 8 sweeping the conical surface of the above cone), the movement period is synchronous with the period of the rotation of the spindle 6; the movements of the above spatial mechanisms are all rotational movements, so there is no any high vibration movement part. The composite result of such spatial movements is that: the piston 1 and the rotating disk 8 relatively swing periodically, the swing period is once the rotation period of the spindle, the amplitude of swing is $4\alpha$; taking the relative swing as the basic movement element for variable displacement, forming the V1 working chamber 4 and the V2 working chamber 11 with the pressure changing alternatively, the air passage 3 is provided on the piston 1, the inlet passage 12 and the exhaust passage 13 are provided on the inner spherical surface of the cylinder cover 2, with the structure as shown in FIG. 2 and FIG. 3; by using the rotation of the piston 1 and the fitting of the spherical surface of the piston 1 with the inner surface of the spherical cylinder of the cylinder cover 2, as the basic movement elements for opening and closing all the inlets and outlets, the air admission control and the exhausting control are realized by making the air passage 3 connected/disconnected with/from the inlet passage 12 and the exhaust passage 13.

In the present embodiment, the piston pin seat 16 is a concave pin seat, the 10 rotating disk pin seat 81 is a convex pin seat; the insert 14 is provided at the bottom of the sump 161 in the center of the piston pin seat 16 as the insert of the piston 1.

As another example of the present embodiment, the piston pin seat 16 may be a convex pin seat, and the rotating disk pin seat 81 is a concave pin seat. That is, it is also possible to provide a sump in the center of the rotating disk pin seat 81, and provide an insert in the sump according to the structures of the pin seats of the piston 1 and the rotating disk 8 in practice. In other words, according to the specific structure of the cylindrical hinge formed by the central pin, the piston pin seat and the rotating disk pin seat, the insert may be positioned in the sump of the piston pin seat or in the sump of the rotating disk pin seat.

Figure 14:
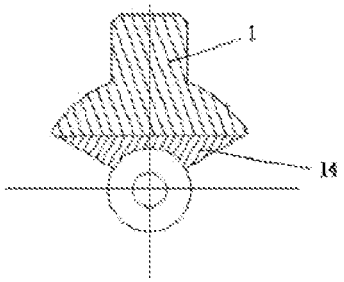
FIG. 14: a structural schematic diagram of the assembly of the piston and the insert in another embodiment.

In practice, it is also possible to design an insert with another structure. As shown in FIG. 14, the top surface of the insert is designed into a plane, the bottom surface of the sump of the piston pin seat fitted therewith is also a plane, and a dynamic seal fit is formed therebetween. Such a structure makes the selection of processing methods more convenient and reduces the manufacture difficulty.

In some cases, the insert may also be fixed in the sump, and the seal effect is achieved by the accuracy fit of the insert and the fitting surface contacting the insert. The above is only the schematic embodiments of the present invention and is not used for defining the scope of the present invention. Any equivalent variations and modifications made by persons skilled in the art without departing the thought and 30 principle of the present invention fall within the protection scope of the present invention.

What is claimed is:

1. An automatic compensation mechanism for a hinge seal gap in a spherical compressor, comprising:

a) a cylindrical hinge formed around a central pin, a rotating disk pin seat, and a piston pin seat of the spherical compressor;

wherein either the rotating disk pin seat or the piston pin seat is a convex pin seat comprising two sides and a center, wherein both sides of the convex pin seat are lower and the center of the convex pin seat is higher, and the other of either the rotating disk pin seat or the piston pin seat is a concave pin seat comprising two sides and a center, wherein both sides of the concave pin seat are higher and the center of the concave pin seat is lower;

wherein the convex pin seat further comprises concave semi-cylindrical grooves at both sides of the convex pin seat and a convex semi-cylinder is in the center of the convex pin seat;

wherein the concave pin seat further comprises convex semi-cylinders at both sides of the concave pin seat and a sump with a bottom surface is in the center of the concave pin seat;

wherein the convex pin seat and the concave pin seat are embedded, and then connected with each other by the central pin being inserted into corresponding pin holes on the convex semi-cylinders thereof;

b) a fan-shaped insert comprising two ends and a center, wherein the fan shaped insert is thicker at both ends and thinner in the center thereof disposed at a bottom of a groove on the concave pin seat forming the cylindrical hinge;

wherein the fan-shaped insert has a shape which matches that of the groove and of an external cylindrical surface of a semi-cylindrical protrusion corresponding to the groove, respectively forming a dynamic seal fit;

wherein the fan-shaped insert is disposed between a bottom of the sump in the center of the concave pin seat and a top of the convex semi-cylinder in the center of the convex pin seat;

wherein the fan-shaped insert has a top surface which is fitted with the bottom surface of the sump;

wherein the fan-shaped insert has a bottom surface which is fitted with an external cylindrical surface of the convex semi-cylinder of the convex pin seat correspondingly embedded in the sump;

wherein the fan-shaped insert is in dynamic seal fit with the concave pin seat and the convex pin seat, thereby forming a cylindrical hinge with sealability;

wherein the fan-shaped insert has two end surfaces that are planar and form a dynamic seal fit with two side walls of the sump;

wherein the fan-shaped insert has two side surfaces that are planar, the two side surfaces of the insert after loaded in the sump are aligned with top surfaces at two end-sides of the sump; and wherein two working chambers are formed at opposed sides of the cylindrical hinge and perform compression alternatively, wherein one of the two working chambers has a pressure higher than that of the other working chamber, the side surface of the fan-shaped insert located at the working chamber having a higher pressure is pressurized, and the fan-shaped insert moves towards the other working chamber having a lower pressure, thereby reducing a gap between the fan-shaped insert and the bottom surface of the sump as well as the cylindrical surface of the semi-cylinder proximate the working chamber having a higher pressure; and the greater the pressure is, the smaller the gap becomes.

2. The automatic compensation mechanism for a hinge seal gap in a spherical compressor according to claim 1, wherein semi-cylindrical contact surfaces in dynamic seal fit are formed between the semi-cylindrical grooves at both sides of the convex pin seat and the semi-cylinders at both sides of the concave pin seat.

3. The automatic compensation mechanism for a hinge seal gap in a spherical compressor according to claim 1, wherein the top surface of the fan-shaped insert is a convex arc surface, and the bottom surface of the sump matched therewith is also an arc surface.

4. The automatic compensation mechanism for a hinge seal gap in a spherical compressor according to claim 1, wherein the top surface of the fan-shaped insert is a plane, and the bottom surface of the sump matched therewith is also a plane.

5. The automatic compensation mechanism for a hinge seal gap in a spherical compressor according to claim 1, wherein the piston pin seat is a concave pin seat and the rotating disk pin seat is a convex pin seat.

6. The automatic compensation mechanism for a hinge seal gap in a spherical compressor according to claim 1, wherein the piston pin seat is a convex pin seat and the rotating disk pin seat is a concave pin seat.

* * * * *